US005465746A

United States Patent [19]

Ebbing

[11] Patent Number: 5,465,746

[45] Date of Patent: Nov. 14, 1995

[54] PNEUMATIC CIRCUIT TO PROVIDE DIFFERENT OPENING AND CLOSING SPEEDS FOR A PNEUMATIC OPERATOR

[75] Inventor: Peter F. Ebbing, Los Altos, Calif.

[73] Assignee: Applied Materials, Inc., Santa Clara, Calif.

[21] Appl. No.: 181,518

[22] Filed: Jan. 13, 1994

[51] Int. Cl.[6] ..... F15B 13/04

[52] U.S. Cl. ..... 137/14; 91/442; 91/443; 137/102; 137/596.17; 251/28

[58] Field of Search ..... 91/442, 443; 137/14, 137/102, 596.17; 251/28

[56] References Cited

U.S. PATENT DOCUMENTS 4,187,764 2/1980 Cho ..... 91/442

*Primary Examiner*—Gerald A. Michalsky
*Attorney, Agent, or Firm*—Janis Biksa

[57] ABSTRACT

A pneumatic circuit prolongs a pneumatic valve opening time using an accumulator with two quick exhaust type valves in series while providing a rapid valve closing time. This structure and method is self-contained and amenable to retrofit in existing installations without any external connections. Slow opening is achieved by routing inlet gas pressure simultaneously to an accumulator and the operating cylinder of the valve to be opened. A tortuous piping path and increased volume to be pressurized due to the addition of the accumulator substantially reduces the isolation valve opening time, thereby eliminating problems associated with quick opening of a pneumatic valve. When the pneumatic valve needs to be closed quickly, slight venting toward the inlet valve immediately causes the quick exhaust valves to vent their downstream pressure. The accumulator then vents through its quick exhaust valve while separately the main quick exhaust valve quickly vents the air cylinder of the pneumatic valve. Closing times penalties of less than 50 milliseconds can be achieved using this configuration and opening times can be increased by adjusting the volume of the accumulator.

5 Claims, 3 Drawing Sheets

Fig. 1 (PRIOR ART)
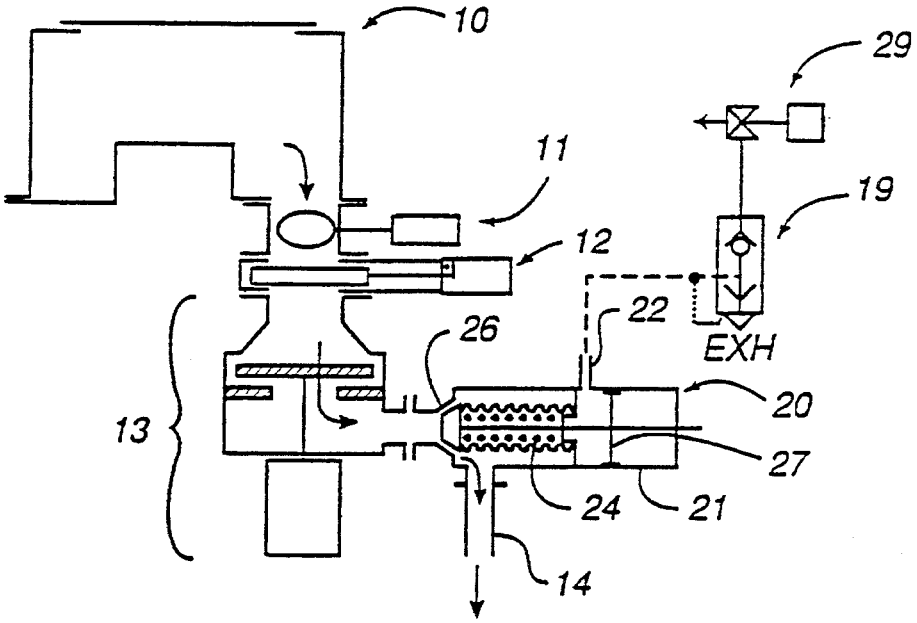
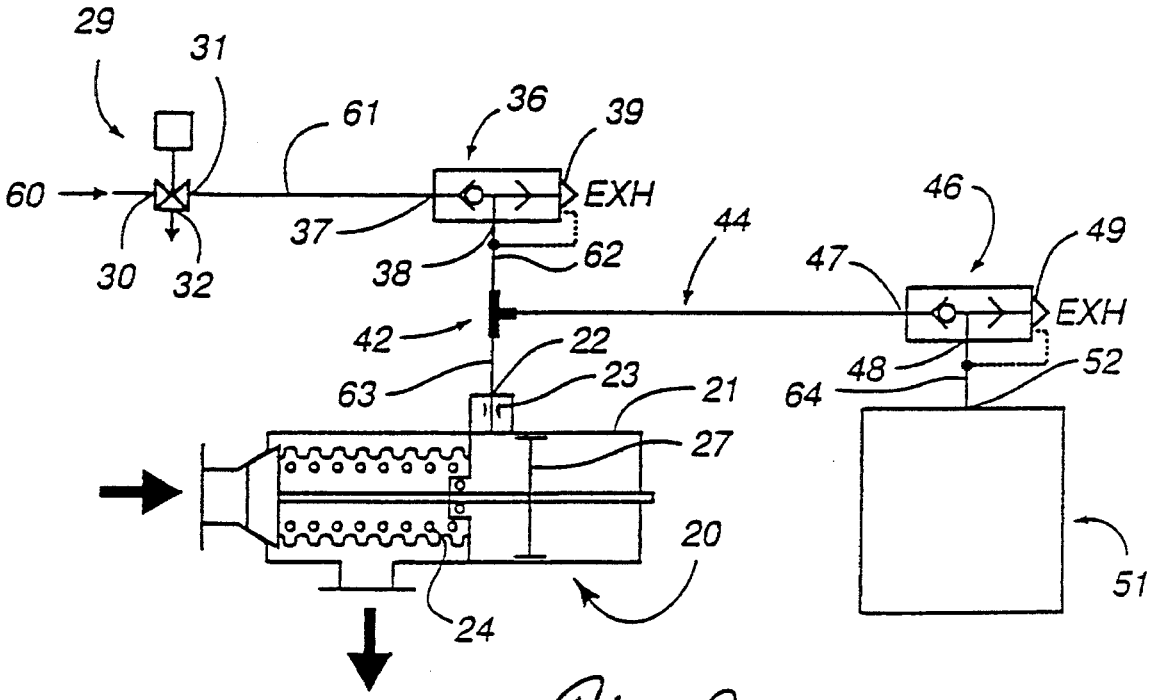
Fig. 2

PNEUMATIC CIRCUIT TO PROVIDE DIFFERENT OPENING AND CLOSING SPEEDS FOR A PNEUMATIC OPERATOR

FIELD OF THE INVENTION

This invention relates to pneumatic circuits for controlling the operating speed of pneumatic isolation (on/off) type valves.

BACKGROUND OF THE INVENTION

In semiconductor processing a low pressure (vacuum) chamber is often used to process substrates. Process gas is introduced to process the substrate and the depleted process gas is evacuated from the processing chamber by a vacuum system.

The vacuum system includes rough vacuum (~1 torr) piping system connected to many processing chambers. Each processing chamber such as illustrated at 10 in FIG. 1 is separated from a normal rough vacuum system piping 14 (connected to the rough vacuum system) by a throttling valve 11, a gate valve 12, a turbo vacuum pump 13 (capable of creating a fine vacuum of $\sim 10^{-11}$ torr—however, typical maximum vacuum in the process chamber is $\sim 10^{-6}$ torr) and an isolation valve 20. The localized vacuum pump 13 often assists the rough vacuum piping system 14 in providing vacuum in the processing chamber. The pump is typically a turbo pump having a magnetically levitated turbo rotor (e.g., Leybold 340 MCT). When the chamber 10 is at a pressure higher than that provided by the rough vacuum system 14, and the throttling and gate valves 11, 12 are open, the process chamber 10 is isolated from the rough vacuum system only by the seal of the isolation valve 20 (e.g., HPS Division of MKS Instruments, Inc. Model 172.0040K). Even though the turbo vacuum pump 13 may be spinning, since its exhaust is sealed, it has little effect on the pressure in the processing chamber 10.

To bring the process chamber to a vacuum, the electric solenoid vent valve 29 is energized, thereby pressurizing an air cylinder 21 of the isolation valve 20 through a quick exhaust valve 19 (e.g., Clippard Instrument Laboratory, Model Minimatic MEV-2). The air pressure pressurizes a piston 27. The piston's movement is opposed by a spring 24. When sufficient pressure and thereby resulting force is introduced, the piston will move with the valve stem to lift the stem from its seat 26, thereby creating an opening through which gas will surge from the high pressure processing chamber 10 to the rough vacuum system connected to the rough vacuum piping 14. The rapid reduction in pressure on the downstream side of the turbo pump 13 causes there to be at least initially a high differential pressure across the turbo pump rotor. The force associated with the differential pressure causes the rotor to be suddenly pushed from its electro-magnetically held levitating position. If the differential pressure across the rotor is sufficiently high (>200mtorr), the spinning rotor may contact its touchdown bearing and may damage it such that the rotor can no longer be used. When the turbo rotor contacts the touchdown bearing brinelling, galling, and premature wear of the touchdown bearing occurs. Such contacts make turbo pump failure imminent. Extensive and time-consuming repairs must then be undertaken as a minimum. In certain instances the turbo pump is not repairable (when the turbo blades touch the stator blades, resulting in severe damage to the blades—known as "helicoptoring").

To prevent rotor bearing contacts the isolation valve must be opened slowly. To safeguard against accidents and disruptions of the rough vacuum piping system, causing backstreaming into the process chamber, the rapid valve closing characteristics (of preferably less than 500 milliseconds) must be maintained.

While orifices are well known as flow and pressure retardants, their use in hindering flow into and out of pneumatic valves is not effective when the orifices plug. When the flow rate to be controlled is quite small, the orifice size must be tiny. When tiny orifices are used, dirt particles can and often do plug the orifice, rendering the flow control system inoperative. The tiny orifices available usually require piping disassembly for access and therefore are not easily maintained. No production-worthy technique exists to warn the operator if plugging of an orifice is imminent.

Further, pneumatic control circuits often have several solenoid valves, one for gas inlet, another for gas exhaust that need to work cooperatively in order for the system to function properly. In these cases both solenoids must function perfectly in coordination for the system to operate acceptably. The problem of orifice sizing and plugging and the need for coordination between several electric devices is a hindrance to field installation or retrofit of new and preexisting devices.

Also, the internal mechanical friction characteristics vary from isolation valve to isolation valve, requiring that the orifice size be tailored to match performance with the valve internal friction. During manufacturing the piston rod seal and piston seal are lubricated. Over time the lubricant is depleted. Once the lubricant is depleted destructive wear begins. The wear creates gaps through which the pressurized air leaks. When the cylinder air leaks equal the flow through the transmission line flow restriction there is no cylinder movement. To overcome these drawbacks, a variable size inlet orifice would be required, the sizing of which would be determined by the changing valve friction and leakage rates.

For example, in one valve-valve air cylinder combination a properly sized orifice is 0.010" (0.25 mm) (the next smaller size (i.e., 0.007" (0.18 mm)) is insufficient to provide air pressure to the valve to operate it properly or at all (the air leaking around the piston flows more quickly than the air through the small orifice). In another valve-valve air cylinder combination a 0.010" orifice might be too small, requiring a larger orifice (0.020" to 0.030" (1.50 mm to 0.75 mm)) to operate properly. Using a 0.020" to 0.030" (1.50 mm to 0.75 mm) orifice in the first case would cause the turbo pump rotor to crash. Therefore orifice sizing is not universal and a variable orifice or other production-worthy methods must be used.

The use of an adjustable pressure regulator is also impractical, because the setting would have to be adjusted only after listening for and hearing the turbo rotor crashing onto its touchdown bearing.

SUMMARY OF THE INVENTION

A pneumatic control circuit according to the invention is spliced into the pressure line running between an inlet electric solenoid valve and an isolation (process chamber/turbo pump) valve air cylinder without any modifications to the existing system.

The pneumatic circuit includes an inlet solenoid vent valve which when energized provides pressurized air flow from its inlet port to its outlet port and when de-energized vents the outlet port to atmosphere or a vent line closing off the inlet port. The inlet valve is connected to a quick exhaust valve. The quick exhaust valve has an inlet port, an outlet port and an exhaust port. When air flow is provided to the inlet port, air flows readily to the outlet port of the quick exhaust valve. The inlet flow also moves a flapper or other movable seal member in the quick exhaust valve to seal the exhaust port. When pressure is reduced at the quick exhaust valve inlet, thereby causing backflow of air through the quick exhaust valve from its outlet port back to its inlet port, the movable flapper in the quick exhaust valve unseals the exhaust opening and seals the inlet opening, thereby immediately exhausting the pressurized air and volume of air connected to the outlet port of the quick exhaust valve.

The quick exhaust valve outlet port is directly connected to the air powered cylinder of the pneumatic valve to be controlled. The outlet port of the quick exhaust valve is also connected to the inlet port of a second quick exhaust valve having operating characteristics similar to that of the first quick exhaust valve. The outlet port of the second quick exhaust valve is connected to an accumulator. The accumulator, during pressurization of the isolation valve to be controlled, effectively increases the volume of the air power cylinder to be pressurized and prolongs the pressure rise time, and thereby slows the opening of the pneumatic valve (which is held closed by an urging means such as a spring). The accumulator attached to the installed piping can be sized to obtain the isolation valve opening time desired.

The use of the quick exhaust valves automatically produces a change from a long tortuous inlet piping system to a short outlet piping system that vents the contained air volume effectively and immediately. The accumulator can be massively larger than the isolation valve air cylinder and be mounted a long distance away without affecting the operation of the outlet piping system operation. Once there is a pressure reduction (backflow) in the inlet port of the second quick exhaust valve (adjacent to the accumulator), the accumulator is isolated and exhausted separately from the exhaust flow of the operating valve air cylinder which discharges rapidly through the exhaust port of the first quick exhaust valve.

In an alternate embodiment, an accumulator is directly connected to the inlet port of the first quick exhaust valve whose outlet port is directly connected to the air cylinder of the pneumatic valve to be controlled. The discharge port of the electric solenoid-vent valve is connected through a fixed (0.030") orifice restrictor and a check valve to the accumulator. The discharge port of the electric-solenoid vent valve is also connected to the inlet port of a second (vent control) quick-exhaust valve whose discharge port is connected to a control port of a large size pneumatically operated accumulator vent valve. The accumulator is connected to the operating inlet port of the vent valve such that when the vent valve is open it vents the accumulator quickly to atmosphere.

The fixed restrictor together with the accumulator provide a dampening effect to slow the opening of the pneumatic valve air cylinder. Pressurizing the second quick exhaust valve also pressurizes the control cylinder of the normally open vent valve to close the vent valve. The accumulator can then be pressurized. Air flowing slowly through the fixed orifice (0.030", a size which provides a good compromise between acceptable performance and potential plugging) slowly pressurizes the accumulator and the power cylinder of the pneumatic (isolation) valve.

When the electric solenoid valve is closed and starts to vent the piping to the second quick exhaust valve, the second quick exhaust valve, sensing backflow, immediately seals its inlet port and vents the control cylinder of the normally open accumulator vent valve through the second quick exhaust valve exhaust port. The normally open vent valve then vents the pressure and volume of air stored in the accumulator and begins discharging the isolation valve air cylinder, creating a backflow through the first quick exhaust valve. As soon as a predetermined backflow is experienced, the first quick exhaust valve seals its inlet port and quickly vents the isolation valve air cylinder through its vent port. All of this venting takes place very quickly such that the time from the close signal to the electric inlet solenoid valve to the closing of the isolation valve is less than one second (1000 milliseconds).

In using systems according to the invention, the opening time of an air-operated isolation type valve is extended substantially, typically 2 to 3 seconds or more and reduces the maximum pressure differential across an adjacent turbo pump in the processing chamber vacuum system such that touchdown of the magnetically levitated rotor due to a pressure differential of approximately greater than 200 mtorr or more does not occur. Avoiding rotor touchdown prevents brinelling of the bearing and avoids pump failure requiring time-consuming and expensive pump change out and/or an extended outage for bearing and/or rotor replacement.

The control system according to the invention is fully mechanical requiring no external wiring or control circuitry and associated software modifications apart from the installation of the mechanical devices in pre-existing control tubing for pneumatic valves.

A BRIEF DESCRIPTION OF THE DRAWINGS

FIG. 1 is a schematic view of a typical processing chamber as it is connected to a rough vacuum piping system with a turbo pump and a poppet-type isolation valve therebetween;

FIG. 2 is a schematic diagram of an embodiment according to the invention;

DETAILED DESCRIPTION

Figure 3:
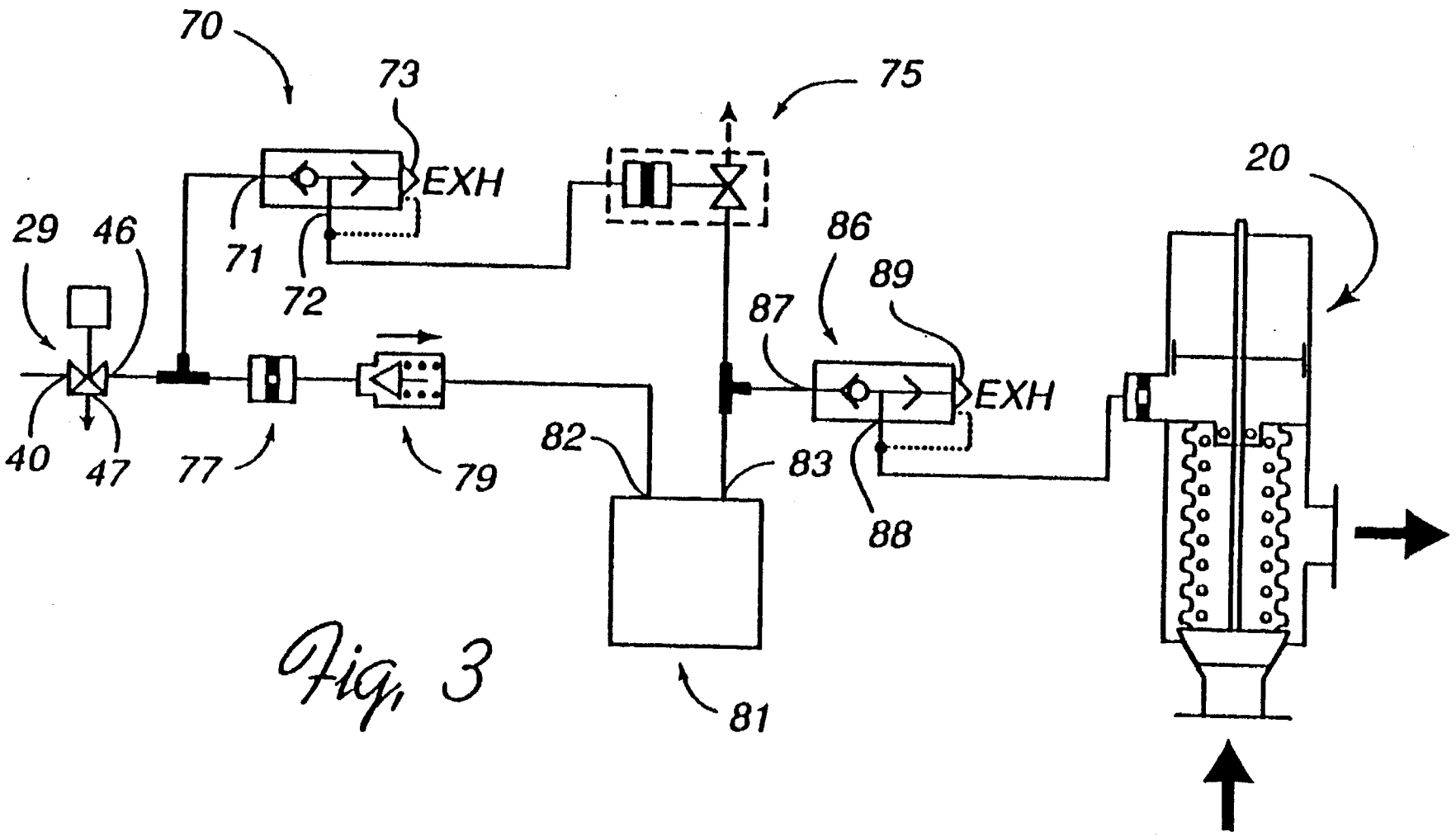
FIG. 3 is a schematic diagram of another embodiment according to the invention.

Several self-contained pneumatic circuits are disclosed which when placed between a normal electric (solenoid) air feed valve and the inlet of a pneumatic isolation (poppet-type) isolation valve provide a structure and method to prolong the opening time of the valve while keeping its closing time (as required for emergencies and process gas mass flow controller calibrations) very short. While a circuit according to the invention is particularly suited to preventing magnetically levitated vacuum pump rotors from touching down as pictured in FIG. 1, it is well suited to other similar applications where it is necessary that a pneumatic actuation time be different than a pneumatic de-actuation time. A configuration according to the invention can be expected to be used successfully to meet such requirements in new or existing installations.

One structure and method to avoid the above-stated problem is shown in FIG. 2. The inlet solenoid valve 29, quick exhaust valve 19 and isolation valve 20 are as shown in FIG. 1. However, several additional components have been introduced to produce the desired result. That is, a slow-opening isolation valve with quick-closing characteristics.

The system consists of replacing the existing connection between the inlet valve 29 (e.g., Clippard Instrument Laboratory, Model EV-3M) and the isolation valve 20 as follows: A main (small) quick exhaust valve 36 (e.g., Clippard Instrument Laboratory, Model Minimatic MEV-2) has its inlet port 37 connected to the outlet port 31 of the electric inlet valve 29 through a tubular line 61. Quite often the inlet electric valve is a ¼" size valve as is the main quick exhaust valve 36.

The characteristic of the electric inlet vent valve 29 is that when energized it provides a direct connection between its inlet port 30 and its outlet port 31. However, when de-energized its inlet port 30 is closed and the outlet port 31 is vented to a vent port 32.

The quick exhaust valve operates as a check valve with a vent. When there is flow from the inlet port 37 of the main quick exhaust valve 36 to its outlet port 38 there is direct communication between these two inlet and outlet ports 37, 38. However, when pressure is reduced at the inlet port 37 (at least an approximately 5 percent of the maximum inlet pressure) such that there starts to be a backflow from the outlet port 38 to the inlet port 37, then a flapper/movable member within the quick exhaust valve 36 moves (just as it does in a check valve) to block backflow from the outlet port 38 to the inlet port 37. As the flapper/movable member moves within the valve it uncovers the opening to the vent port 39. Therefore when there is a slight backflow from the outlet port 38 to the inlet port 37 in the quick exhaust valve, that slight backflow triggers the opening of the vent port 39 which is then directly connected to the outlet port 38 thereby venting any air flowing from the downstream piping to the outlet port 38. In using this quick exhaust valve, inlet flow in the first direction is contained in the valve and routed from the inlet port to the outlet port while flow in the reverse direction is stopped and immediately vented to a vent port which in this configuration goes to atmosphere, or a vent line.

The outlet port 38 of the main quick exhaust valve 36 is connected to inlet port 22 of the air cylinder 21 of the isolation valve 20. Piping section 62 and 63, together with a tee fitting 42 connect these two ports. The tee fitting 42 connects a branch line 44 to an accumulator quick exhaust valve 46.

The accumulator (large) quick exhaust valve 46 (e.g., SMC NAQ 3000-02) has an inlet port 47, an outlet port 48 and a vent port 49 as previously described for the main quick exhaust valve 36. The outlet port 48 is connected to the inlet port 52 of an accumulator 51 (e.g., Parker Hannifin, Corp. Cliff Impact Div., Aluminum Cylinder, Model 2326-P) by a piping line 64. The accumulator 51 and accumulator quick exhaust valve 46 are mounted closely together compared with their distance from the main quick exhaust valve 36 and the isolation valve 20.

The tubing line 44, connecting the tee fitting 42 to the inlet port 47 of the accumulator quick exhaust valve can vary substantially in length (e.g. from approximately 0 to 10 feet) without any noticeable difference in system performance. The inlet tubing 61 to the main quick exhaust valve 36 can be purposely made small (e.g. 0.0625" I.D. (1.58 mm)) to provide additional resistance on filling the system.

The distance between the main quick exhaust valve 36 and the inlet port 22 of the isolation valve 20 is minimized as much as possible (e.g. close nipple on busing connections). The tee fitting 42 can provide the main structural connection between the main quick exhaust valve 36 and the isolation valve 20, thus eliminating any real piping lengths associated with pipes 62 and 63 as shown in FIG. 2. The tee fitting 42 can be a bushing into the side of which has been drilled a small hole to accept 1/16" tubing. The inner diameter of this bushing is generally the same size as the piping leading to the isolation valve, i.e. ⅜", ½", ¾", etc., to provide generally unobstructed flow between the main quick exhaust valve outlet port 38 and the inlet port 22 of the isolation valve 20. The main isolation valve cylinder inlet orifice 23 (part of the valve 20) is sized such that full flow from the air cylinder 21 of the isolation valve 20 will flow quickly through the main vent valve 36 from the outlet port 38 to the vent port 39 with a minimum amount of restriction while still avoiding damaging the valve seat from an excessive slamming force.

The system operation is as follows: On pressurization an air source 60 normally provides a pressure to an inlet port 30 of the electric solenoid valve 29. In a de-energized state the discharge port 31 of the solenoid valve 29 communicates with and is vented to the vent port 32 of that valve. When the electric solenoid valve 29 is energized the inlet port 30 communicates directly with the discharge port 31 and no air is vented through the vent port 32. Air travels through piping line 61 to the inlet port 37 of the main quick exhaust valve 36. A movable flapper/member within the valve 36 moves to seal the exhaust port 39 and air flows from the inlet port 37 through the valve 36 and out to the outlet port 38. Air then flows to the tee fitting 42 and branches to flow towards both the air cylinder 21 of the isolation valve 20 and the accumulator quick exhaust valve 46. Air flow upon reaching the inlet port 47 of the accumulator quick exhaust valve 46 moves the flapper/movable member within the valve to seal the exhaust port 49 and flow is directed from the inlet port 47 to the outlet port 48 and passes through the line 64 and into the accumulator 51.

The time to pressurize a large volume accumulator is proportionately greater than the time required to pressurize a small volume. With this in mind, the size of the accumulator 51 can be chosen such that its volume, together with that of the air cylinder 21 provides an acceptable (slow) opening time for the valve 20.

Typical air cylinder and accumulator volumes are respectively 1.13 $in^3$ (18 ml)(minimum volume when not pressurized) and 25 $in^3$ (400 ml).

In this configuration as the air flows into the air cylinder 21 and the accumulator 51 the pressure in the system slowly increases until the force on the piston 27 within the air cylinder 21 is greater than the spring force due to the closing spring 24 holding the isolation valve closed on its seat plus the friction drag forces of the piston rod and piston seals. The valve stem slowly lifts from its seat and flow across the seat begins. As the pressure continues to increase the piston 27 moves slowly until the isolation valve 20 is fully open. Under this filling scenario, air must flow from the inlet solenoid valve 29 through the piping 61 through the main exhaust valve 36 and fill both the accumulator and the air cylinder 21 to a pressure equal to that pressure required to lift the valve from its seat before the valve actually lifts. As the valve stem lifts from its seat, flow causes the pressure difference between the processing chamber 10 and the vacuum system connected to the vacuum piping 14 to be gradually reduced, thereby reducing the chance for, if not completely eliminating, damage to the turbo vacuum pump 13 rotor touchdown bearing due to an operating touchdown.

It is necessary that the isolation valve 20 be able to close very quickly in less than 500 milliseconds when required. Under this configuration closing requires only a very slight air movement through the long filling passages and provides immediate opening to atmosphere through a very short path to discharge the pressurized air in the valve operating air cylinder 21.

The closing scenario is as follows. When the electric solenoid valve 29 is de-energized the discharge port 31 communicates with the vent port 32, thereby causing air to flow from the inlet port 37 of the main quick exhaust valve 36 back towards the electric valve 29. This flow cause the flapper/movable member in the main quick exhaust valve 36 to immediately seal the inlet port 37 and provide a path from the outlet port 38 to the exhaust port 39 of the main quick exhaust valve 36. Typical air pressure differential across the flapper is 5 psi to actuate the flapper (or at least an approximately 5 percent drop in the inlet port pressure). The pressure in the air cylinder 21 immediately starts to discharge through its inlet port 22, the piping 63, 62, the tee fitting 42 and the outlet port 38 of the main quick exhaust valve 36 quickly reaching ambient air pressure through exhaust port 39. Once there is a slight reduction in pressure due to the venting of the air cylinder 21 through the exhaust port 39, the air in connecting line 44 also starts to flow through into the tee fitting 42. Once there is a slight flow towards the tee fitting 42, the flapper/movable member within the accumulator quick exhaust vent valve 46 moves to seal the inlet port 47 of the valve 46, preventing recharging of air cylinder 21 from the accumulator 51 and discharge the air contained in the accumulator 51 through the exhaust port 49. After an initial slug of air has closed the inlet port 47 of the accumulator quick exhaust valve 46 there is no cross-flow between the air and the accumulator 51 and the air discharging from the isolation valve air cylinder 21. The air from the isolation valve 20 is thereby discharged almost immediately through a very short route thereby providing a very fast closing time which meets the 500 millisecond requirement. The addition of accumulator 51 and its quick exhaust valve 49 adds only approximately 50 milliseconds maximum and 30 milliseconds nominal to the closing time of the prior art configuration. The sizes of the various pieces and presently used devices are as follows:

| | Effective Orifice ($in^2$-($mm^2$)) | |
|---|---|---|
| | IN → OUT | OUT → EXH |
| Small (main) exhaust valve | 0.013-(.8) | .0048-(3) |
| Large (accumulator) exhaust valve | 0.064-(40) | .068-(42) |

The ratio of accumulator volume to the air cylinder volume of the isolation valve when the system works appears to be 10:1 minimum, 20:1 preferred and larger ratios depending upon the desired opening time.

To obtain a rapid closing of the pneumatic valve 20 there should be as little volume and resistance as possible between the air cylinder and the discharge port of the first quick exhaust valve. The volume of the piping (tubing) connection between the first quick exhaust, valve and the second quick exhaust valve should therefore be as small as reasonably possible (e.g., 1/16" I.D.).

An alternate embodiment of a pneumatic circuit for slow opening and quick closing of a pneumatic valve according to the invention is shown in FIG. 3. In this embodiment an accumulator 81 is placed in line between the air source solenoid valve 29 and the isolation valve 20. Solenoid valve 29 is connected to an orifice 77 which connects to a check valve 79 permitting flow only in the direction of an accumulator 81. The accumulator discharge port 83 is connected through to a normally open pneumatically operated vent valve 75 as well as to an isolation quick exhaust valve 86.

A vent valve quick exhaust valve 70 is connected between the electric solenoid inlet valve 29 and the operating cylinder of the pneumatic vent valve 75.

System operation is as follows. When the electric solenoid vent valve 29 is energized, pressure is provided to the inlet port 71 of the vent valve quick exhaust valve 70, thereby moving the flapper/movable member within the valve to seal the exhaust port 73 of the valve. Air flow is then provided to the discharge port 72 of the quick exhaust valve 70 and starts to close the pneumatically operated vent valve 75. Simultaneously, air flow is metered through an orifice 77 (approximately a 0.030" hole) and through the check valve 79 to an inlet port 82 of the accumulator 81. The restrictor 77 also provides sufficient back pressure in the line between valve 29 and check valve 79 such that the normally open (NO) vent value 75 is closed before check valve 79 is activated. As the accumulator pressurizes, air flows out its outlet port 83 and towards the normally open pneumatically operated vent valve 75 now closed and the isolation quick exhaust valve 86. With the pneumatic valve 75 closed, the air flow from the accumulator discharge port 83 flows into the inlet port 87 of the quick exhaust valve 86. The movable flapper/movable member of the isolation quick exhaust valve 86 moves to seal the exhaust port 89 of the valve 86. Air flow from the inlet port 87 then flows out the outlet port 88 of the valve 86 and into the air cylinder of the isolation valve 20. Once the air cylinder is pressurized, the piston of the isolation valve slowly lifts the valve stem to gradually open the valve and gradually equalize the pressure between the process chamber 10 and the rough vacuum system. This minimizes the pressure differential experienced across the turbo vacuum pump 13 during initial depressurization of the processing chamber 10.

When it is necessary to close the isolation valve quickly the solenoid valve 29 is de-energized, thereby venting the outlet port of the solenoid valve 29 to its vent port 47. The check valve 79 having closed, there is no backflow from the accumulator 81 back towards the solenoid valve but rather the air cylinder of the normally open pneumatic valve 75 starts to discharge through the solenoid vent port 47, but as soon as a small amount of air has passed from the discharge port 72 of the vent quick exhaust valve 72 to its inlet port 71, the valve flapper/movable member moves to seal the valve inlet port 71 and creates a passage from the outlet port 72 to the exhaust port 73, thus rapidly opening the large capacity pneumatically operated vent valve 75.

As the pressure in the accumulator 81 decreases rapidly by being vented through the vent valve 75, the reduction in pressure causes backflow from the air cylinder of the isolation valve 20 through the isolation quick vent valve 86. When backflow happens, the flapper/movable member moves to seal the inlet port 87 and connect the outlet port 88 to the exhaust port 89. The exhaust flow from the air cylinder of the isolation valve 20 flows through the outlet port 88 directly to the vent port 89 to quickly discharge the air cylinder of the isolation valve 20. This configuration results in an isolation valve closing time of 1000 milliseconds maximum (which exceeds the system design closing requirement of 500 msec, but may be appropriate for other configurations with less stringent requirements).

Figure 4:
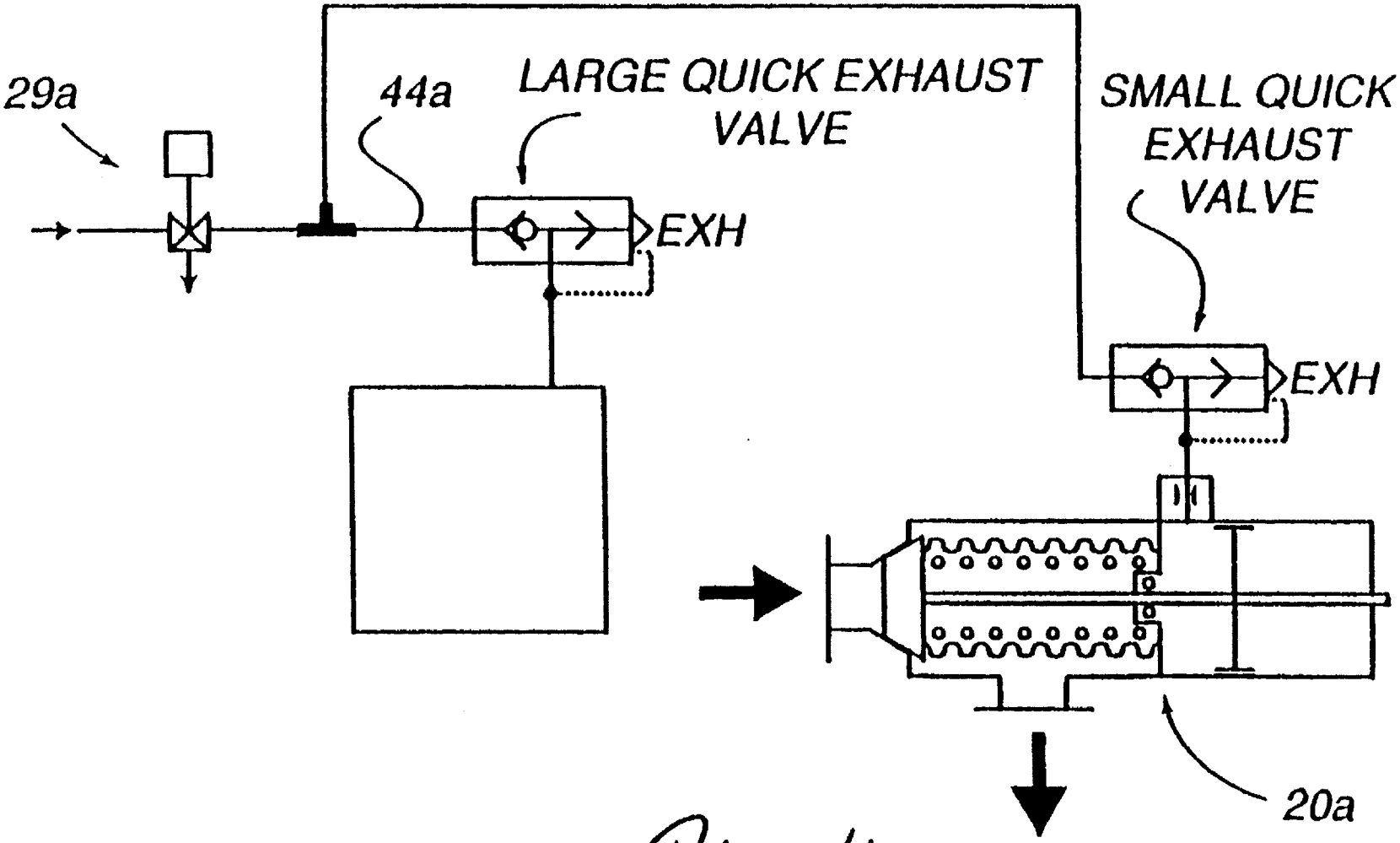
FIG. 4 is a schematic diagram of another embodiment according to the invention.

FIG. 4 shows another configuration according to the invention. An accumulator feed line 44*a* is directly connected to an inlet air valve 29*a*, other parameters of 26 this configuration being similar to those described for FIG. 2. The closing time for the isolation valve 20*a* in this configuration increases to 700 milliseconds and therefore exceeds the system required closing time of 500 milliseconds.

While the invention has been described with regard to specific embodiments, those skilled in the art will recognize that changes can be made in form and detail without departing from the spirit and scope of the invention.

I claim:

1. A pneumatic circuit for controlling the opening and closing of a pneumatically operated valve which opens on application of pressure to its operating cylinder and closes on release of pressure from its operating cylinder comprising:

an remotely operated inlet valve having an inlet opening, an outlet opening, and a vent opening, wherein when said inlet valve is energized said inlet opening communicates with said outlet opening but not with said vent opening, and wherein when said inlet valve is not energized said outlet opening communicates with said vent opening, but not with said inlet opening;

a first quick exhaust valve having an inlet opening connected to said outlet opening of said remotely operated inlet valve, said first quick exhaust valve having an outlet opening separate from said inlet opening and an exhaust opening separate from said inlet and said outlet openings, when there is an air flow into said inlet opening, said quick exhaust valve provides a connection between its inlet and outlet openings, but no connection between said exhaust opening and either said inlet or said outlet openings, when there is a reduction in the inlet pressure of at least approximately 5 percent with a corresponding air flow from said outlet opening to said inlet opening, said inlet opening is sealed and said outlet opening communicates with said exhaust opening;

a tee fitting having an inlet opening, a first outlet opening, and a second outlet opening, said tee fitting inlet opening being connected to said outlet opening of said quick exhaust valve, said first outlet opening of said tee fitting being connectable to the operating cylinder of said pneumatically operated valve;

a second quick exhaust valve having an inlet opening connected to said second outlet opening of said tee fitting, said second quick exhaust valve having an outlet opening separate from said inlet opening and an exhaust opening separate from said inlet and said outlet openings, when there is a gas flow into said inlet opening, said quick exhaust valve provides a connection between its inlet and outlet openings, but no connection between said exhaust opening and either said inlet or said outlet openings, when there is a reduction in the inlet pressure of at least approximately 5 percent with a corresponding gas flow from said outlet opening to said inlet opening, said inlet opening is sealed and said outlet opening communicates with said exhaust opening; and an accumulator having an inlet connected to said outlet opening of said second quick exhaust valve.

2. A pneumatic circuit for controlling the opening and closing of a pneumatically operated valve which opens on application of pressure to its operating cylinder and closes on release of pressure from its operating cylinder comprising:

a remotely operable inlet vent valve;

a first quick exhaust valve having an inlet port connected to a discharge port of said vent valve;

a second quick exhaust valve having an inlet port connected to a discharge port of said first quick exhaust valve;

an accumulator tank connected to a discharge port of said second quick exhaust valve;

wherein the operating cylinder of said pneumatically operated valve is connected to said discharge port of said first quick exhaust valve.

3. A pneumatic circuit for pressurizing a pneumatic device at a first rate and de-pressurizing the pneumatic device at a second rate comprising:

an inlet vent valve;

first quick exhaust valve means having an inlet port, an outlet port and an exhaust port, wherein said inlet port communicates with an outlet port of said inlet vent valve;

an outlet line connecting said outlet port of said first quick exhaust valve means with an inlet opening for pressurizing the pneumatic device;

second quick exhaust valve means having an inlet port, an outlet port and an exhaust port, wherein said inlet port communicates with an outlet port of said first quick exhaust valve means; and an accumulator connected to said outlet port of said second quick exhaust means;

wherein when said inlet vent valve is energized, a gas flow from an inlet port of said inlet vent valve communicates with said outlet port of said valve, gas flow being provided to said inlet port of said first quick exhaust valve;

wherein gas flow provided to said inlet ports of said first and said second quick exhaust valves, respectively, are provided to said outlet ports of said first and second quick exhaust valves, respectively, wherein when said inlet vent valve is de-energized, said outlet port of said valve communicates with said vent port of said valve, wherein when a flow occurs from said outlet ports of said first and said second quick exhaust valve means, respectively, to said inlet ports of said first and said second quick exhaust valve means, respectively, said inlet ports of said valve means, respectively, are sealed and said outlet ports communicate with said exhaust ports of said valve means, respectively.

4. A pneumatic circuit for pressurizing a pneumatic device at a first rate and de-pressurizing the pneumatic device at a second rate comprising:

an inlet vent valve having a vent valve outlet port;

an accumulator;

a main quick exhaust valve connected between said vent valve outlet port and a pressurization opening of said pneumatic device;

an accumulator quick exhaust valve connected between an outlet port of said main quick exhaust valve and said accumulator;

wherein when said inlet valve is de-energized, said main quick exhaust valve directs the gas from pressurization opening of said pneumatic device to vent through an exhaust port of said main quick exhaust valve, wherein when said main quick exhaust valve directs the gas from pressurization opening of said pneumatic device to vent through an exhaust port of said main quick exhaust valve, said accumulator quick exhaust valve directs the gas from said accumulator to vent through an exhaust port of said accumulator of said quick exhaust valve.

5. A method of pressurizing a pneumatic device at a first rate and de-pressurizing a pneumatic device at second rate, different from said first rate, comprising the steps of:

pressurizing the pneumatic device at the first rate by:

providing gas flow through a solenoid/vent valve simultaneously to a pressurization opening of the pneumatic device and an accumulator;

routing said gas flow through a main quick exhaust valve;

routing an accumulator portion of said gas flow through an accumulator quick vent valve to said accumulator;

de-pressurizing the pneumatic device at a second rate by:

releasing gas pressure from a vent port of said solenoid/vent valve routing gas flow from said pneumatic device through a main quick exhaust valve to a vent port of said valve; and routing gas flow from said accumulator to through said accumulator quick vent valve to a vent port of said valve.

* * * * *